United States Patent [19]

Pyburn

[11] Patent Number: 4,569,301

[45] Date of Patent: Feb. 11, 1986

[54] UTILITY CONTAINER FOR CATAMARAN SAILBOATS

[76] Inventor: Robert M. Pyburn, 724 SE. Baker, Albany, Oreg. 97321

[21] Appl. No.: 702,813

[22] Filed: Feb. 19, 1985

Related U.S. Application Data

[63] Continuation-in-part of Ser. No. 568,901, Jan. 4, 1984, Pat. No. 4,528,925.

[51] Int. Cl.[4] ..... B63B 25/00

[52] U.S. Cl. ..... 114/61; 114/343; 114/364

[58] Field of Search ..... 114/61, 343, 363, 364

[56] References Cited

U.S. PATENT DOCUMENTS

| | | | |
|---|---|---|---|
| 2,712,293 | 7/1955 | O'Higgins | 114/61 |
| 3,784,317 | 1/1974 | Currey | 114/61 |
| 3,824,733 | 7/1974 | Cordell | 43/54.1 |
| 3,958,289 | 5/1976 | Carlson | 114/364 |
| 4,108,100 | 8/1978 | Jamieson | 114/61 |
| 4,266,707 | 5/1981 | Rossman | 114/363 |
| 4,398,488 | 8/1983 | Mathieu | 114/363 |
| 4,428,617 | 1/1984 | Lawson | 114/363 |

FOREIGN PATENT DOCUMENTS

| | | | |
|---|---|---|---|
| 2291087 | 7/1976 | France | 114/61 |

*Primary Examiner*—Trygve M. Blix
*Assistant Examiner*—Thomas J. Brahan
*Attorney, Agent, or Firm*—Chernoff, Vilhauer, McClung, Birdwell & Stenzel

[57] ABSTRACT

An improved trampoline and a utility container for holding personal articles aboard a small catamaran sailboat, with separate internal compartments including an insulated icebox compartment. The container is shaped to fit in a location near the front of the passenger-carrying area of the catamaran, occupying space ahead of the trampoline. A display area for instruments is included in an upper section of the container. A flexible lower portion of the container is held rearward and upward, out of the way of waves. The trampoline is attached to the catamaran's frame and to the utility container so as to provide an uninterrupted upper surface.

13 Claims, 13 Drawing Figures

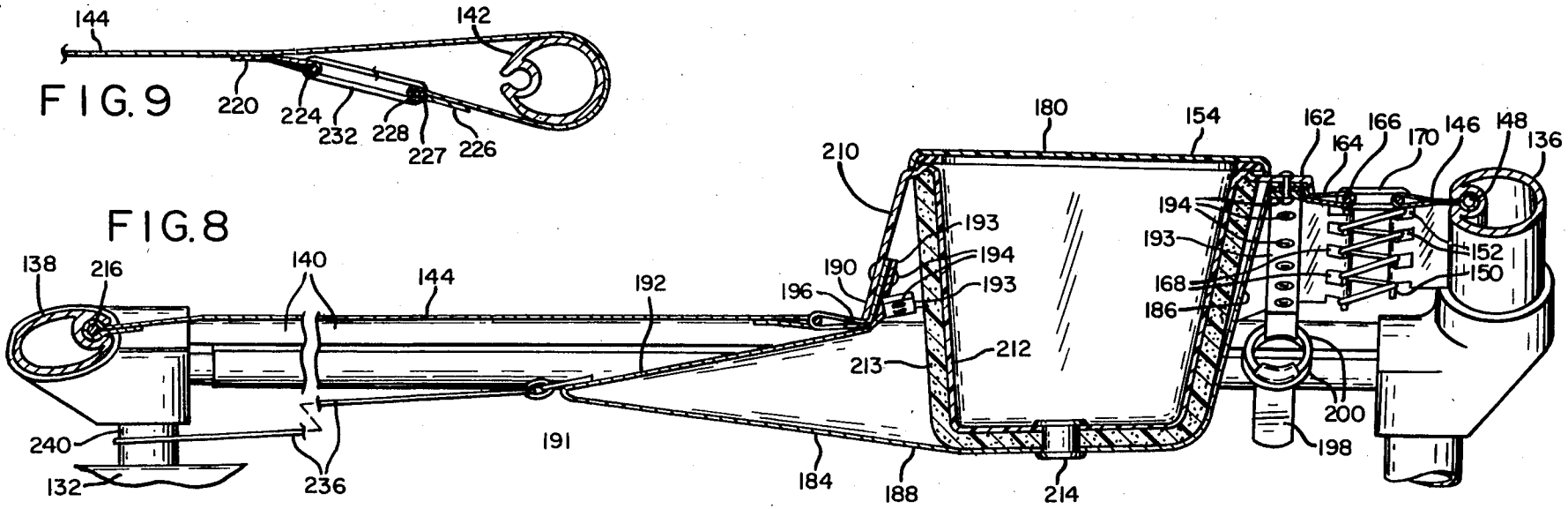
FIG. 8
FIG. 9
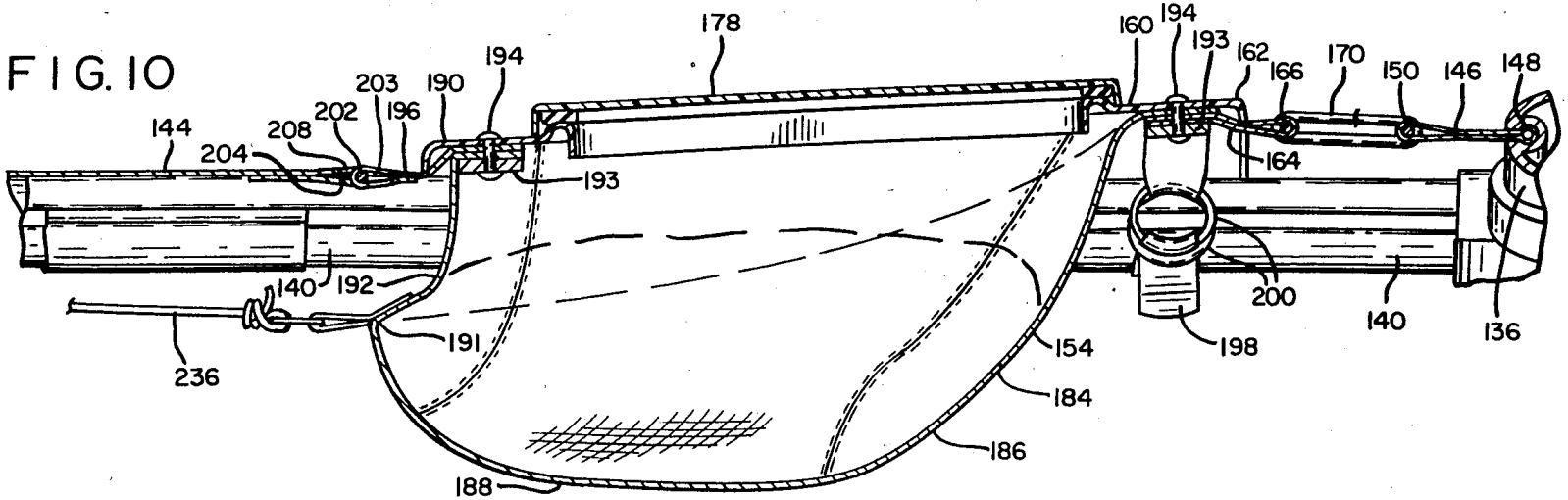
FIG. 10

UTILITY CONTAINER FOR CATAMARAN SAILBOATS

REFERENCE TO PRIOR APPLICATION

This application is a continuation-in-part of copending U.S. patent application Ser. No. 568,901, filed Jan. 4, 1984, U.S. Pat. No. 4,528,925.

BACKGROUND OF THE INVENTION

The present invention relates to sailboats, and particularly to a container for use aboard small catamaran sailboats for holding personal articles such as spare clothing and refreshments.

Smaller sailboats of the twin hull, or catamaran, type are designed for "day sailing" and often lack any built-in storage compartments. Although built primarily for recreational sailing for relatively short times and distances, such small catamarans may nevertheless be sailed at times when the weather is changeable, or for periods of time long enough to make it desirable to take along food, extra clothing, or special sailing equipment whose usefulness depends upon particular conditions. Naturally, it is desirable to protect such articles from loss and, in the case of food and clothing, from becoming unnecessarily wetted by spray or rain. This has been unnecessarily difficult in the past aboard most small catamarans, of 20 feet and shorter length, for example, since such boats usually have only a platform of tightly stretched cloth (called a trampoline) to support people.

Such small catamaran sailboats are often used on lakes, where the water is often fairly calm, and it is frequently possible to relax and consume refreshments leisurely aboard the boat. Since there is no storage space provided on such small catamarans, refreshments, extra sailing equipment, or spare clothing carried aboard such a boat must be tied down, occupying space where it may interfere with sailing the boat. Such articles are, then, likely to obstruct people aboard the boat, be accidentally lost overboard, get wet, or simply take up space undesirably.

Some owners of sailboats find instrumentation such as a compass, a wind speed and direction indicator, and a water speed indicator desirable. However, in the popular commercially available catamarans not large enough to include solid cockpits or cabin structures there is ordinarily no space available for mounting the indicator dials of such instruments.

Trampolines previously used on catamaran sailboats are fastened to a portion of the supporting framework and are tightened by lacing, leaving an area of the trampoline which is partly open, except for the lacing, and which thereby presents a danger of a person's foot being entangled in the lacing. Also, the grommets previously used cause undesirable stress concentrations in the fabric. It is desirable, then, to provide an improved manner of attachment of the trampoline, by which these disadvantages are avoided.

What is needed, therefore, is an improved trampoline associated with a utility container which can be added to a conventional small catamaran sailboat, and which includes protected storage space for personal articles of clothing, for equipment used to sail the boat, and for beverages or food for consumption aboard such a sailboat. Preferably such a utility container would also provide room for mounting display units of instruments useful in sailing such a catamaran and be strong enough to support the people aboard such a catamaran. Such a utility container must, of course, be securely attachable to a catamaran because of the normal wide range of motion and attitude of such a sailing craft, and the trampoline associated with the utility carrier should be made as safe as possible.

SUMMARY OF THE INVENTION

The present invention provides a utility container for use aboard small catamaran sailboats which lack cockpits or cabins having storage compartments, together with an improved trampoline which cooperates with the utility to provide a safe place for people on such a boat. The utility container, in one embodiment, may be manufactured of glass-reinforced synthetic resin, using conventional methods, or of other suitably strong materials such as aluminum. It has a rigid bottom section which extends transversely along the front portion of the passenger platform of a small catamaran sailboat. A front wall of the lower portion of the container slopes rearwardly and downwardly to help deflect spray and wind. The container is preferably divided into three compartments by vertical dividers separating a deep center compartment from a shallower compartment located at each side.

In another embodiment of the invention the bottom section is flexible and is normally held rearward and as high as practical by elastic restraining members, so as to provide a maximum of clearance above the water between the hulls.

A top section of the container covers the bottom section, enclosing the storage compartments. The upper surface of the top section is arched upwardly, preferably, to correspond with the arch of a transverse frame member of one type of catamaran, simultaneously providing greater depth in the center compartment of the container.

An insulated ice chest is optionally located in the center compartment of the utility container where it may be permanently attached. The center compartment is preferably provided with a drain extending from the ice chest through the bottom of the utility container.

Separate openings are provided in the top section of the container to provide access into each compartment, and a closable cover having a watertight seal is provided for each opening. The generally horizontal upper surfaces of the container and the compartment covers are preferably coated with a non-skid material so that a person can sit or stand on top of the container without danger of slipping.

A rearwardly and downwardly sloping area of the top section of the container, located rearward of the access opening for the center compartment, is convenient for installation of display units of such instruments as a compass, a wind indicator and a water speed indicator.

The trampoline according to the present invention has one longitudinal margin which is retained by being received in a channel extending along one longitudinal side frame member of the boat. Along the opposite longitudinal portion of the trampoline, a lacing extends between a pair of rods disposed, respectively, within a folded-over and secured longitudinal marginal portion of the trampoline and a similar marginal portion of an elongate piece of material attached to the underside of the trampoline and extending parallel with the longitudinal edge of the trampoline. Lacing between the rods retains the second longitudinal side of the trampoline and provides lateral tension in the trampoline.

A front margin of the trampoline is fastened, in piano-hinge fashion, to the rear of the utility container by a rod extending through intermeshed fabric loop portions of a front marginal hemmed portion of the trampoline and rearwardly extending loops defined by portions of a similarly folded-over and secured hemmed portion of a strip of fabric material attached to the rear side of the carrier.

It is therefore a principal object of the present invention to provide a watertight storage container for protecting personal articles aboard a small catamaran sailboat.

It is another important object of the present invention to provide a utility storage container having a plurality of separate compartments, including an insulated compartment for storage of chilled refreshments aboard a catamaran.

It is yet a further object of the present invention to provide a convenient location for mounting of display dials for instruments such as a compass, wind speed indicator, and water speed indicator.

It is an important feature of one embodiment of the container of the present invention that when it is not in use the bottom section of the container is held up out of the way of water passing between the hulls of the boat.

Another important feature of the invention is that it provides a trampoline, for use in combination with the utility carrier, providing an upper surface uninterrupted by open lacing.

It is an important advantage of the present invention is that it provides a safer location for storage of personal articles aboard a small catamaran sailboat than has previously been available.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 8 is a sectional side view of the catamaran shown in FIG. 7, taken along lines 8—8.

FIG. 9 is a detail view taken along line 9—9 of FIG. 7, showing the structure by which lateral tension is maintained in the trampoline.

FIG. 10 is a right side detail view taken along line 10—10 of FIG. 7, showing the manner of attachment of the upper section to the lower section of the utility carrier of FIG. 7.

DETAILED DESCRIPTION OF THE INVENTION

Figure 4:
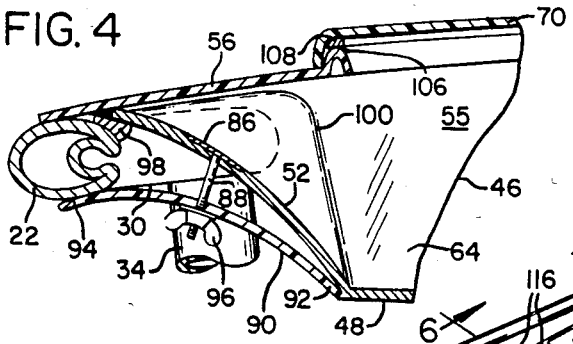
FIG. 4 is a sectional rear elevational view of the left end portion of the container shown in FIG. 2, taken along line 4—4.
Figure 1:
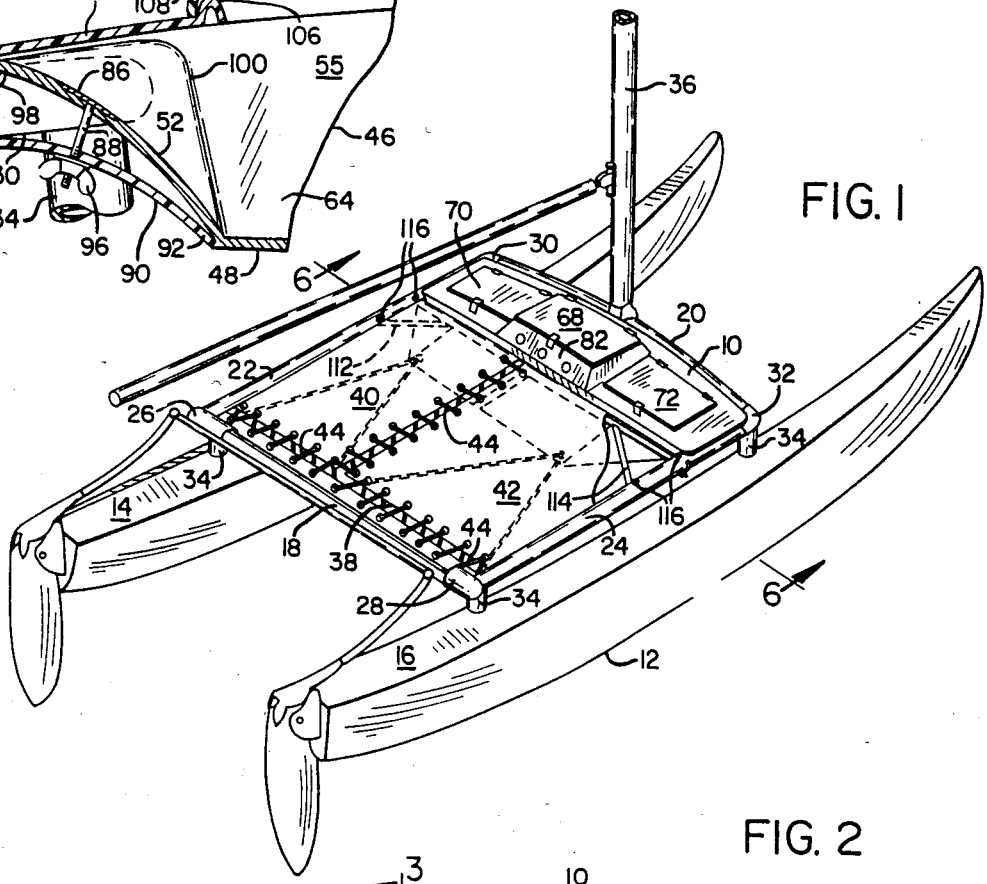
FIG. 1 is a perspective view of a small catamaran sailboat equipped with a utility container embodying the present invention.
Figure 2:
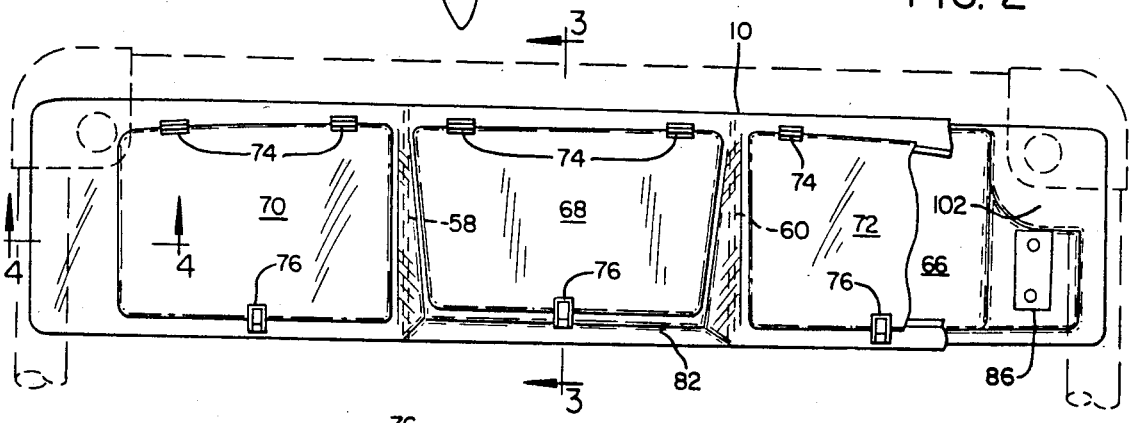
FIG. 2 is a top plan view of the utility container shown in FIG. 1, along with a portion of the catamaran shown in FIG. 1, at an enlarged scale.
Figure 3:
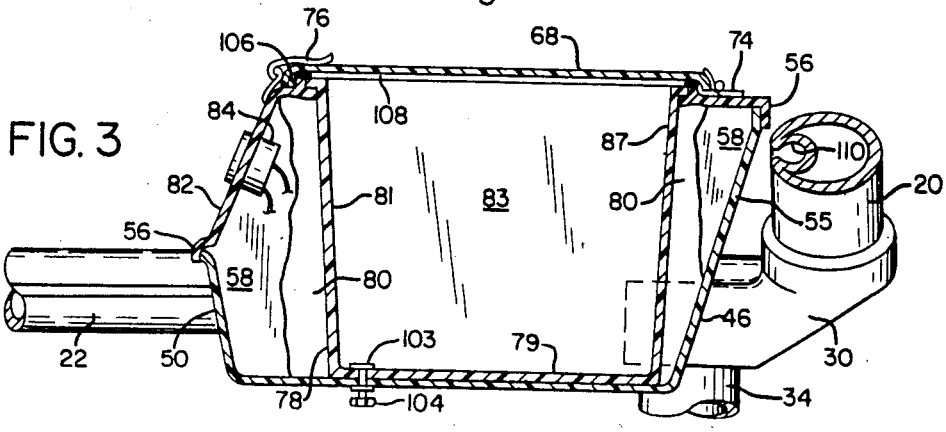
FIG. 3 is a sectional side view taken along the line 3—3 in FIG. 2.
Figure 5:
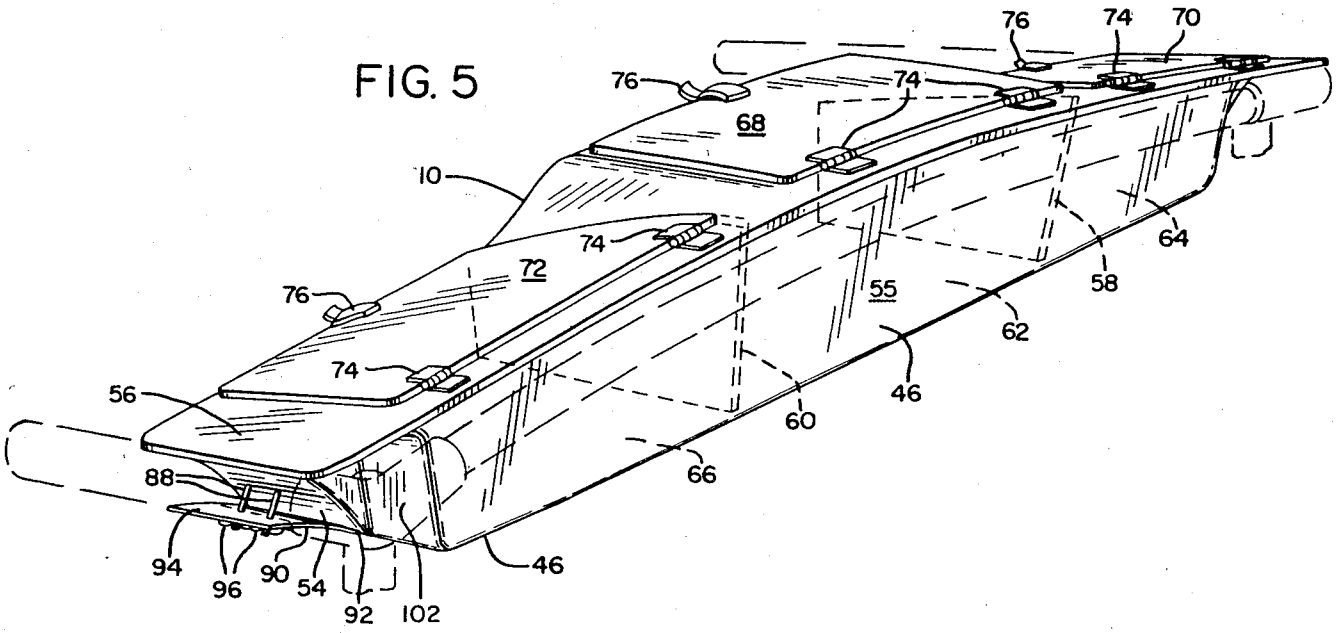
FIG. 5 is a perspective view of the container shown in FIG. 1, taken from the front upper right.
Figure 6:
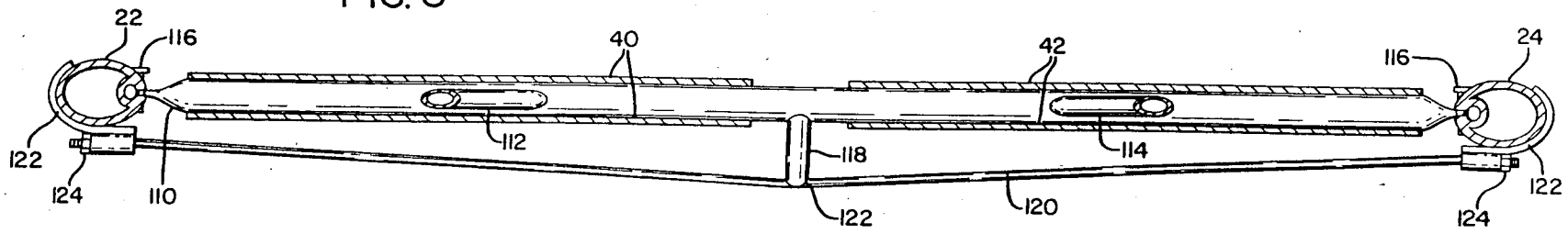
FIG. 6 is a rear elevational view of a portion of the catamaran shown in FIG. 1, taken along line 6—6, showing the structure supporting the front end of the trampoline of the catamaran when the utility container shown in FIG. 1 is in use.

Referring now to the drawings, a utility container 10 which is a preferred embodiment of the present invention is shown in FIG. 1 mounted on a catamaran sailboat 12. The catamaran sailboat 12 has a pair of elongate hulls 14 and 16 which extend parallel with one another and are held in this relationship with one another by a frame including a rear transverse frame member 18, a forward transverse frame member 20, and a pair of longitudinal frame members 22 and 24 which are fixedly connected with one another by respective corner pieces 26, 28, 30 and 32. Two of the corner pieces are connected to each of the hulls 14 and 16 by respective pylons 34 which extend vertically upward from the hulls. The forward transverse frame member 20 is curved in a low upwardly convex arch and supports a mast 36 which is stepped on the forward transverse frame member 20.

A cloth trampoline 38, including a left portion 40 and a right portion 42, is tightly stretched within the frame, with an outer longitudinal edge of each of the left and right portions 40 and 42 of the trampoline 38 being slideably engaged within a C-shaped slideway provided in the respective longitudinal frame member 22 or 24. Lacing 44 interconnects the right and left portions 40 and 42 with one another and permits the trampoline 38 to be tightened as necessary to provide support for people aboard the catamaran. Similarly, lacing 44 connects the rear edges of the left and right trampoline sections 40 and 42 with the rear transverse frame member 18.

Referring now also to FIGS. 2–5, the utility container 10 is made of glass fiber-reinforced resin construction in the conventional manner, preferably being laid up in layers of glass fiber cloth impregnated with resin. A bottom section 46 includes a bottom wall 48, a rear wall 50, a left end wall 52, and a right end wall 54 and a front wall 55. A top section 56 is fastened to the bottom section 46 by an adhesive resin, thereby forming a watertight seal between the bottom section 46 and the top section 56.

Preferably, a pair of vertical longitudinal dividers 58 and 60 are provided within the container 10, dividing it into three side-by-side watertight compartments, a center compartment 62 and a pair of outboard compartments, a left compartment 64, and a right compartment 66. The top section 56 defines an opening into each of the compartments 62, 64, and 66, with respective covers 68, 70, and 72 being provided as watertight closures for each of the compartments 62, 64, and 66. Each of the covers 68, 70, and 72 is attached to the top section 56 by hinges 74 and may be held closed by a releasable latch 76. As a safety precaution, the hinges 74 and latches 76 are of a somewhat flexible resilient synthetic plastic material.

The center compartment 62 is deeper than either the left compartment 64 or right compartment 66, providing room for an icebox liner 78, which is also of glass-reinforced resin construction and includes a bottom 79, four upstanding walls 81, 83, 85 and 87, and has an upper rim 89. The liner 78 is preferably fixedly attached within the center compartment 62, but may alternatively be removable therefrom. In the preferred embodiment of the invention, the rim 89 of the icebox liner 78 is adhesively attached to the top section 56, within the access opening to the center compartment 60, by adhesive resin, and the liner 78 is surrounded by a layer 80 of thermal insulating material which may, for example, be a foam material expanded in place.

The upper surface of the top section 56 is inclined upwardly toward the edges of the opening of the center compartment 62, and includes a rear panel 82 which slopes upwardly and forwardly from the central portion of the rear edge of the top section 56, where it joins with the corresponding upper edge of the rear wall 50. The rear panel 82 is spaced rearwardly from the rear wall 81 of the icebox liner 78 far enough to permit installation of instrument indicator housings 84. The housings 84 are preferably sealingly fitted into appropriate holes provided for that purpose in the rear panel 82, to preserve the overall watertight integrity of the utility container 10.

Each of the right and left end walls 52 and 54 extends slopingly upward and outward from the bottom wall 48 and is downwardly concave toward the respective longitudinal frame member 22 or 24. A reinforcing plate 86 is adhesively attached to the inner side of each of the end walls 52 and 54, with a pair of clamp bolts 88 extending from each of the reinforcing plates 86 through the respective end wall. A clamp plate 90, also of fiberglass reinforced resin material, is associated with each side of the utility container 10. A first end 92 of each clamp plate 90 is located adjacent the respective side wall where it joins the bottom wall 48. The clamp bolts 88 extend through the respective clamp plate 90, and a second end 94 of each clamp plate 90 is held tightly against the underside of the respective longitudinal frame member 22 or 24, by a fastener such as a wing nut 96 engaging threads provided on each of the clamp bolts 88 to tighten the clamp plates 90 against the longitudinal frame members. Preferably, a resilient cushion member 98, for example, a rubber strip, is located between each of the end walls 52 and 54 and the respective longitudinal frame member 22 or 24.

Because of the location of the pylons 34 and the shape of the corner pieces 26, 28, 30, and 32, depressions 100 and 102 are provided in the bottom section 46, to permit the container 10 to fit snugly against the rear side of the front transverse frame member 20, between the longitudinal frame members 22 and 24, as shown in FIGS. 1, 2, 5, and 6. Thus the utility container 10 is located mainly below the original level of the trampoline, and the top of the utility container remains available as a place to sit or stand, instead of being cluttered by articles carried aboard the boat.

A drain tube 103 extends downwardly from the icebox liner 78 and the bottom wall 48 of the bottom section 46 of the container 10. The drain tube 103 is equipped with a closable valve 104 to permit the icebox liner to be continuously drained, if desired, or to retain liquid as it melts from ice contained within the icebox liner 78.

An upstanding edge 106 surrounds each opening in the top section 56 through which access is available to each of the center, left, and right compartments 62, 64 and 66, respectively. A seal member, for example, a resilient rubber strip 108, is adhesively attached to the bottom side of each of the covers 68, 70, and 72 to sealingly fit against the edge 106 when the respective cover 68, 70, or 72 is closed.

Ordinarily, a front edge bolt rope (not shown) attached to the front edge of the respective left and right portions 40 and 42 of the trampoline 38 is held within a C-shaped trackway defined by the forward transverse frame member 20, to hold the respective left and right portions 40 and 42 of the trampoline 38 forward against the tension exerted rearwardly on the trampoline 38 by the lacing 44. With the container 10 in place on the catamaran 12, it is necessary to provide an alternative forwardly located member to support the front of the trampoline 38. Accordingly, a crossbar 110 extends transversely along the rear of the container 10, with respective left and right ends of the crossbar 110 being located within the C-shaped trackways provided in the longitudinal frame members 22 and 24 to hold the lateral edges of the trampoline sections 40 and 42. The crossbar 110 may, for example, be a piece of 1-inch diameter heavy-wall aluminum pipe. Respective left and right diagonal braces 112 and 114 extend diagonally inward and forward from the longitudinal frame members 22 and 24, being welded to points of attachment along the crossbar 110. Stop screws 116 are located in holes provided in each of the longitudinal frame members 22 and 24 to prevent rearward motion of the crossbar 110 and the diagonal braces 112 and 114 under tension exerted by the trampoline portions 40 and 42.

To support the downward stress applied against the crossbar 110, a downwardly extending centrally located leg 118 is fixedly attached to the underside of the crossbar 110 and extends downward a distance of, for example, 8 inches. A truss 120, which may be a metal rod, extends transversely of the catamaran beneath the crossbar 110, resting in a notch 122 defined in the lower end of the downwardly-extending leg 118. Each end of the truss 120 is threaded and extends through a bore provided in a hook 122, which may be, for example, of cast aluminum. The hooks 122 fit around the bottom and outer sides of the respective longitudinal frame members 22 and 24. A self-locking nut 124 is used to tension the truss 120 inwardly against the longitudinal frame members 22 and 24, thus exerting an upward force through the downwardly-extending leg 118 against the bottom of the crossbar 110. The left and right portions 40 and 42, respectively, of the trampoline 38 are wrapped around the crossbar 110 and extend rearwardly toward the rear transverse frame member 18, being held under tension by additional lashings extending through grommets provided in the trampoline left and right sections 40 and 42.

Referring next to FIGS. 7–11, a catamaran sailboat 130, similar to the catamaran 12, includes a pair of hulls 132 and 134 which are parallel with one another. A front transverse frame member 136 interconnects the hulls 132 and 134 near their forward ends, and an after transverse member 138 structurally connects the hulls 132 and 134 near their after ends. In the catamaran 130, which may, for example, be equivalent to a 16-foot Hobie Cat TM, a pair of longitudinal structural members 140 and 142 interconnect the forward and after transverse members 136 and 138 on the port and starboard sides of the boat, respectively, and are located spaced a short distance above the hulls 132 and 134. Each of the structural members 136, 138, 140, and 142 includes a C-shaped channel of the type commonly used, for example, in metal masts and booms of sailboats to receive marginal portions of sails having bolt ropes attached thereto. All of these channels face toward one another and are provided for the purpose of attaching a trampoline 144 in conventional catamarans which are of a size small enough that a solidly built deck is not provided between the hulls.

Referring now particularly to FIGS. 8 and 10, it may be seen that a transversely-extending fastener strip 146 of fabric is doubled over upon itself and secured so as to present a folded edge facing rearwardly from the forward transverse structural member 136. A bolt rope 148 securely attached to the strip 146 is engaged in the channel provided on the transverse member 136.

A rod 150, which may be a glass-fiber-reinforced plastic rod of solid construction and approximately $\frac{3}{8}$ inch thick extends within the folded fabric strip 146, parallel with the forward transverse member 136 and spaced a short distance, such as about $1\frac{1}{2}$ inches, rearward therefrom. A plurality of openings 152 are provided in the fabric 146, exposing the rod 150 at intervals of, for example, 3 inches, along the length of the transverse member 136.

A utility carrier 154 extends transversely between the longitudinal structural members 140 and 142. The port and starboard ends 156 and 158 of an upper section 160 of the utility carrier 154 rest, respectively, on the longitudinal structural members 140 and 142. Extending along a forward marginal portion 162 of the upper section 160 is a transversely-extending folded fabric fastening strip 164 which holds a rod 166, similar to the rod 150, within its forwardly-facing folded edge. A plurality of openings 168 are provided along the folded edge of the fabric fastening strip 164, to expose the rod at a plurality of locations spaced apart from one another, along the forward marginal portion 162 of the utility container 154, by a distance equal to the spacing between the similar openings 152 provided along the rearwardly facing folded edge of the forward fastening strip 146. The openings 168 are located offset laterally to a position centrally between the openings 152, and a lacing 170 of, for example, $\frac{3}{8}$ inch diameter braided Dacron cord is laced in a zig-zag fashion around the rods 150 and 166.

The upper section 160, like the upper section of the utility container 10, includes three access openings into the interior compartments each preferably equipped with a respective hingedly attached watertight cover 178, 180, or 182, each having a respective latch.

Figure 7:
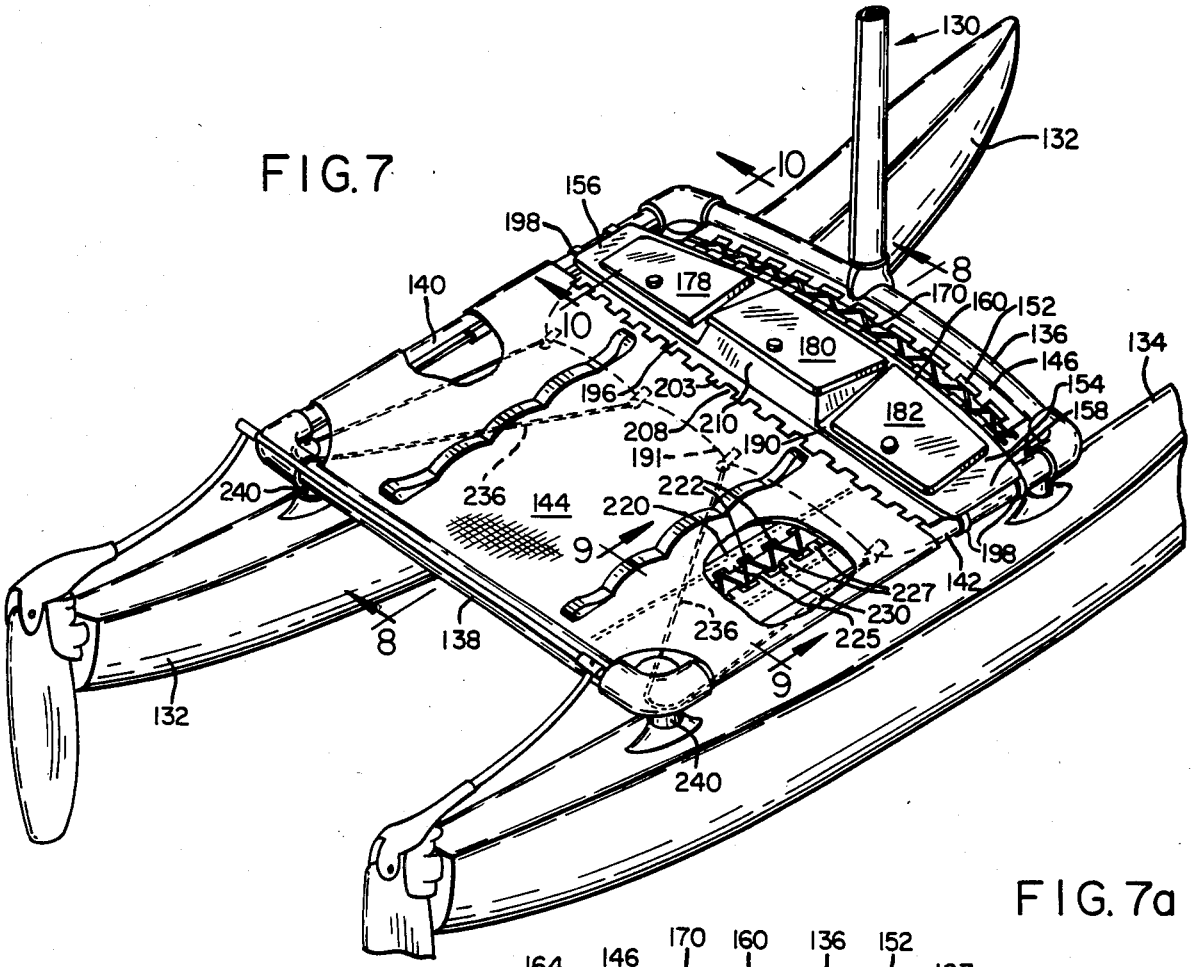
FIG. 7 is a partly cut-away perspective view from the upper right rear of a catamaran including an alternative embodiment of the present invention.
Figure 7A:
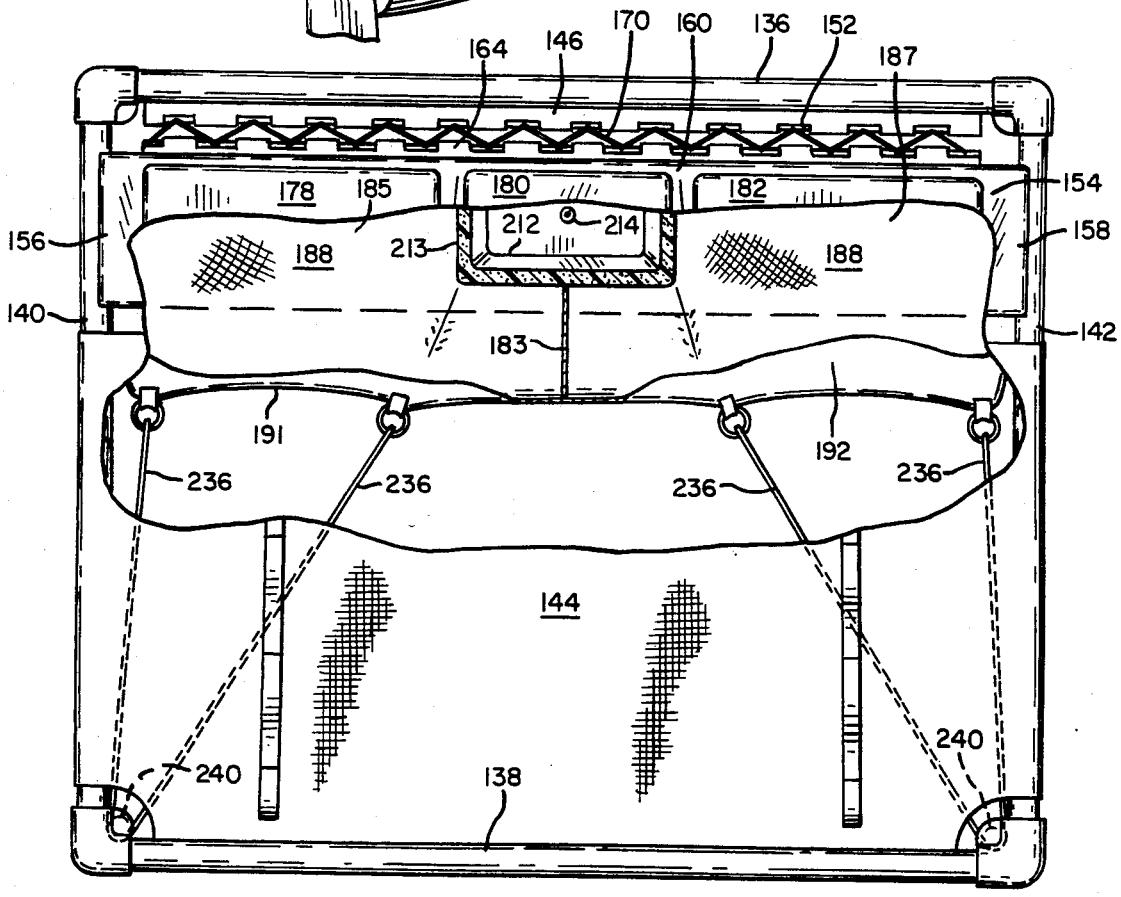
FIG. 7*a* is a partly cut-away simplified top plan view of the trampoline and utility carrier for the catamaran shown in FIG. 7.

Suspended beneath the upper section 160 is a flexible bottom section 184 comprising a bag made of a sturdy fabric. In a relaxed state, the bottom section 184 hangs downwardly beneath the front marginal portion 162 and extends rearwardly and downwardly beneath the upper section 160. A forward wall 186 extends, in a relaxed position, generally vertically downwardly beneath the forward transverse marginal portion 162 of the upper section 160. A floor 188 extends generally horizontally rearwardly from the bottom of the forward wall 186, to a position rearward of the rear marginal portion 190 of the upper section 160. A rear wall 192 extends slopingly rearwardly and downwardly to the rear edge of the floor 188, meeting it along a transversely extending lower rear portion 191 of the bottom section 184. Preferably, the bottom section 184 includes a vertically-extending fabric divider 183 separating the interior of the bottom section 184 into separate compartments 185 and 187, as shown in FIG. 7*a*.

The bottom section 184 is attached to the upper section 160 along the forward and rear marginal portions 162 and 190 by long narrow laterally extending clamp plate members 193 which are attached to the upper section 160 by rivets 194 located at regular intervals along the front and rear marginal portions 162 and 190 and along the port and starboard ends 156 and 158. The clamp plate members 193 may be of glass-reinforced plastic material similar to that of the upper section 160. The forward fabric fastening member 164, and a similar rearwardly facing fastening strip 196, extending transversely along the rear marginal portion 190 of the upper section 160, are also attached to the upper section 160 by the same laterally extending clamp plates 193 and rivets 194.

Figure 11:
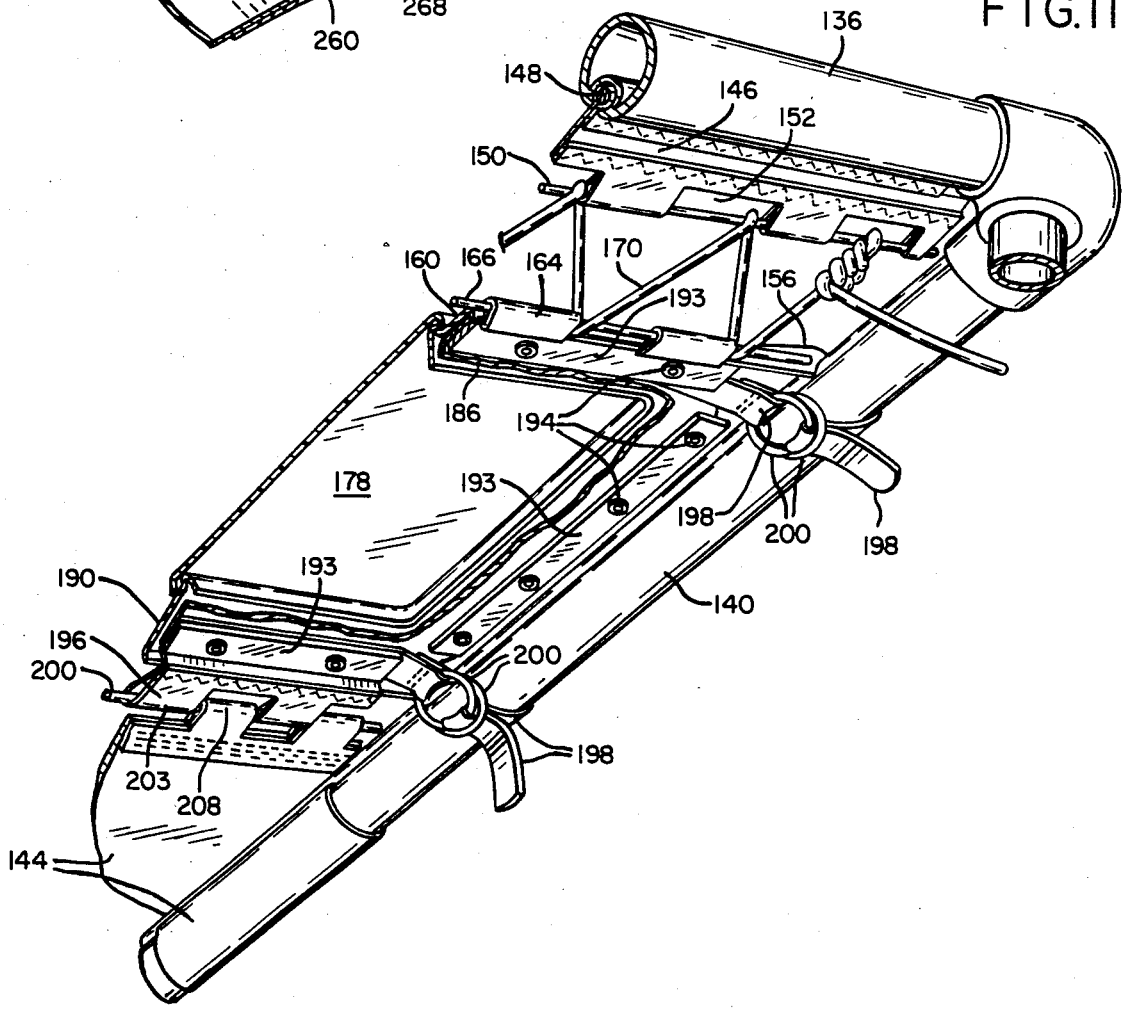
FIG. 11 is a perspective detail view of the straps attaching the port end of the utility container of the present invention to one of the longitudinally-extending rails of the catamaran.

At each of the port and starboard ends 156 and 158 a pair of flexible straps 198 extend around the respective longitudinal structural member 140 or 142, as shown in FIG. 11. The straps 198 are fastened securely by a pair of D-rings 200 or other secure but releasable means, where the utility container 154 is used with a catamaran such as the catamaran 130 which includes such raised longitudinal structural members 140 and 142. In a different catamaran, where there is no structural member around which the straps 198 may be placed, the ends 156 and 158 may be permitted simply to rest upon the members which normally would support a portion of a trampoline at that location, were the utility carrier 154 not provided.

The rear fastening strip 196 is interrupted at regular intervals by openings. A rod 202 extends through loops 203 formed by the fold in the rear fabric fastener strip 196. A forward marginal portion 204 of the trampoline 144 also comprises a laterally extending folded-over and secured edge serving as a fabric fastener member. The marginal portion 204 includes openings and fabric loops 208, which are spaced so as to receive the fabric loops 203 and enter into openings in the rearwardly-facing fastening strip 196, with the rod 202 extending through the fabric loops 203 and 208 to join them together in piano-hinge fashion, parallel with the rear marginal portion 190 of the upper section 160.

As in the utility carrier 10, the utility carrier 154 includes a sloping surface 210 located beneath and to the rear of the central opening 174, as a suitable instrument panel for mounting instrument indicator dials. Additionally, a rigid container 212 is preferably provided and formed integrally with the upper section 160, located directly beneath and communicating with the central opening 174. Preferably, the container 212 is provided with insulation in the form of polystyrene foam 213 molded about the outer surfaces of the container 212 as insulation for ice and cold beverages to be contained within the container 212. A drain 214 is provided in the bottom of the container 212 and extends downwardly through the floor 188 of the bottom section 184.

In order to provide a smooth, uninterrupted upper surface, the trampoline 144 preferably includes an enlarged edge portion, containing, for example, a bolt rope 216, extending along its port longitudinal edge and its rearward transverse edge and engagable within the C-shaped tracks provided in the after transverse structural member 138 and the port side longitudinal structural member 140. Preferably, the trampoline is installed by first sliding the bolt rope 216 of the port longitudinal edge of the trampoline into the channel provided in the port longitudinal member 140, and thereafter wrapping the trampoline around the bottom and upward about the outer side of the longitudinal member 140, as illustrated in FIGS. 7 and 10. Thereafter the bolt rope 216 of the after transverse edge of the trampoline is fitted into the channel extending along the forward side of the after transverse structural member 138, as shown in FIG. 8, and the trampoline is extended horizontally from port to the starboard side of the catamaran 130.

A longitudinally extending inboard fastening strip 220 of fabric including a folded-over and secured marginal portion is securely fastened, as by sewing, to the trampoline on its underside, as may be seen in FIG. 9. The inboard fastening strip member 220 extends longitudinally at a distance of about 15 inches inboard from the starboard longitudinal structural member 142. The fastening strip 220, like the forward fastening strip 146, includes several openings 222. A rod 224, similar to the rod 150, extends within the fabric loops thus defined by the fastening strip 220 and is exposed through the openings 222.

The starboard longitudinal marginal portion of the main piece of fabric of the trampoline 144 is folded back defining a tubular folded marginal portion 226 secured, as by sewing, and enclosing in loops 227 a longitudinally-extending rod 228 exposed through a plurality of openings 230. The starboard longitudinal marginal portion 226 of the trampoline 144 is draped over and around the outside of the starboard longitudinal structural member 142 and its marginal edge portion 226 is held parallel with the inboard fastening strip 220 by means of a lacing 232, similar to the lacing 170, which extends zig-zag fashion around the rods 224 and 228.

By tightening the lacings 232 and 170, the trampoline 144 is placed under tension in both transverse and fore-and-aft directions, with the fore-and-aft tension being transmitted through the upper section 160 of the utility carrier 154 by means of the forward and after fabric fastening strips 164 and 196, providing a taut upper surface of the trampoline for supporting people aboard the catamaran 130.

In order to maintain a maximum amount of vertical clearance above the water beneath the trampoline 144 and utility carrier 154, between the hulls 132 and 134, a pair of elastic retainers 236 are attached, respectively, at the port and starboard lower rear corners and locations spaced inboard from the corners along the bottom rear portion 191 of the bottom section 184. The elastic retainers 236 may, for example, be of "bungee cord" or similar elastic cord material. The retainers 236 preferably extend rearwardly and are looped around a rearwardly located portion of the structure of the catamaran 130, for example, the vertical posts 240 located beneath the intersection of the respective longitudinal structural member 140 or 142 and the after transverse structural member 138, so that the elastic retainers 236 ordinarily hold the bottom section 184 stretched rearwardly and snugly raised toward the bottom surface of the trampoline 144, except to the extent that articles stowed in the utility container 154 hold the bottom section 184 down.

Figure 12:
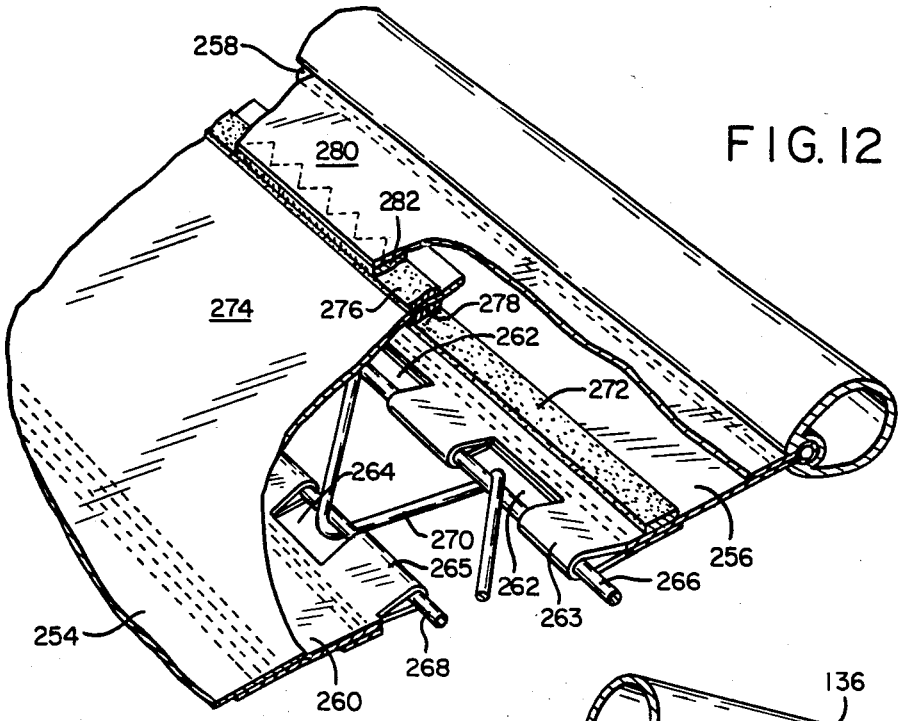
FIG. 12 is a sectional view similar to that of FIG. 9, showing an alternative attachment of one side of the trampoline, to a catamaran having a different configuration.

On some catamarans which differ in their construction from that of the catamaran 130, there are no raised longitudinal structural members such as the longitudinal structural members 140 and 142. Channels or other fastening devices are provided atop the hulls of such a catamaran to receive the longitudinal marginal portions of a trampoline which is ordinarily laced together along a longitudinally extending fore-and-aft gap in the trampoline. In another embodiment of the trampoline of the present invention, suitable for the just-described type of catamaran, attachment of one longitudinal side of a trampoline is accomplished as with the conventional trampoline, by fastening that side of the trampoline into a channel provided. At the opposite side, for example the starboard side of a trampoline 254, of which only a portion is shown in FIG. 12, a side fastening strip 256, similar to the forward transversely extending fastening strip 146 shown in FIGS. 7–9 is mounted in the channel 258. An inboard fabric fastening strip 260 is secured to the underside of the trampoline 254, extending longitudinally parallel with the outboard longitudinal fastening strip 256, as does the inboard fastening strip 220 of the trampoline 144 described previously. The outboard fastening strip 256 provides a folded edge defining openings 262, and, similarly, the inboard fastening strip 260 includes a folded edge defining openings 264 which are spaced apart from one another and offset longitudinally of the catamaran with respect to the openings 262, to receive respective rods 266 and 268 extending longitudinally of the catamaran within the loops 263 and 265 formed in the fastening strips. A lacing 270 of suitable cord such as $\frac{3}{8}$ inch diameter braided Dacron TM cord is used to pull the inboard and outboard fabric fastening strips 256 and 260 toward one another to provide tension in the fabric of the trampoline 254 itself.

A strip 272 of one of the mating portions of a hook-and-loop combination fastener material extends along the upper side of the outboard fastening strip 256. The trampoline 254 extends further outward (to starboard) beyond the line of attachment of the inboard fastening strip 260, in a marginal portion 274. A pair of strips 276 and 278 of mating fastener material are fastened to the marginal portion 274, on the top and bottom, respectively, extending along the full length of the trampoline 254. The bottom strip 276 can be matingly fastened to the strip 272 provided on the outboard fastening strip 256.

An upper cover flap 280, which may be an inwardly directed extension of the fabric of the outboard fastening strip, is located above the marginal portion 274. The flap 280 includes a strip 282 of hook-and-loop fastening material which mates with the strip 278 located on the top of the outboard marginal portion 274 of the trampoline to secure the flap 280 to the upper side of the marginal portion 274 of the trampoline 254. This provides a smooth upper surface without exposing the lacing which maintains the tension in the trampoline 254. The strips 272, 276, 278, and 282 may, for example, be of the hook-and-loop fastening material commonly known under the trademark Velcro TM.

The front and rear transverse margins of the trampoline 254 may be attached as previously described in connection with the trampoline 144, in conjunction with a utility carrier such as the utility carrier 154.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. In combination with a catamaran sailboat having a pair of generally parallel hulls and a fabric trampoline extending generally horizontally between the hulls to support people while sailing the sailboat, a utility container for protectively carrying personal articles, the utility container comprising:

(a) a rigid upper section extending transversely between said hulls and having transversely extending rear and front marginal portions and defining at least one access opening communicating with the interior of said utility container;

(b) a flexible bottom section defining a storage bag suspended beneath said upper section and extending below said trampoline between said hulls, said storage bag having a lower rear portion; and (c) elastically extensible retainer means connected with said lower rear portion of said bottom section, extending rearwardly beneath said trampoline and fastened to a part of said sailboat located rearwardly from said upper section, for holding said bottom section in a raised, rearwardly-extended configuration beneath said trampoline when said bottom section is empty, yet elastically yielding in response to said bottom section extending downwardly as required to receive and contain articles to be carried therein.

2. The utility container of claim 1 wherein said upper section extends across substantially the entire distance between said parallel hulls of said catamaran, said upper section having a pair of opposite port and starboard ends and strap means associated with each of said ends for attaching said ends to said catamaran.

3. The utility container of claim 1, said upper section including a transversely-extending rear marginal portion and including means associated with said rear marginal portion for fastening said trampoline to said rear marginal portion.

4. The utility container of claim 3 wherein said means for attaching said trampoline to said rear marginal portion includes a folded elongate sheet of fabric extending transversely of said catamaran along said rear marginal portion of said upper section, said fabric being fastened to said upper section and defining a plurality of rearwardly-extending loop means spaced apart from one another transversely along said rear marginal portion, for receiving a rod extending through said loop means and through a plurality of corresponding forwardly-extending loops of fabric, located on a forward marginal portion of said trampoline and extending between said loop means of said rear marginal portion of said upper section, and interconnecting said rear margin and said trampoline to each other.

5. The utility container of claim 1 wherein said upper section includes means for defining a plurality of access openings therethrough and includes an instrument display area located rearwardly adjacent one of said plurality of access openings.

6. The utility container of claim 5, including respective cover means hingedly attached to said upper section for closing each of said access openings.

7. The utility container of claim 5, including a rigid container fixedly attached to and extending downwardly beneath a central portion of said upper section, within said flexible bottom section, and in communication with a centrally located one of said access openings.

8. The utility container of claim 7, including fixedly located means for defining a drain for said rigid container, said drain extending downwardly through said flexible bottom section.

9. In a catamaran sailboat, having a pair of generally parallel hulls and a trampoline of fabric extending generally horizontally between said hulls as support for persons aboard the sailboat, and said trampoline having oppositely located first and second longitudinally-extending marginal portion, the improvement comprising:

(a) a utility container having a rigid upper section extending transversely between said hulls and having transverse rear and front marginal portions, said upper section defining at least one access opening therethrough for communicating with the interior of said utility container;

(b) a flexible bottom section defining a storage bag beneath said upper section and extending below said trampoline between said hulls, said storage bag having a lower rear portion;

(c) a pair of longitudinal frame members, each extending fore-and-aft and spaced upwardly apart from a respective one of said hulls, at least one of said longitudinal members including means for securely receiving first longitudinal marginal portion of said trampoline;

(d) first fabric means connected with said trampoline for defining a first plurality of loops spaced apart from one another longitudinally of said catamaran in a row extending substantially parallel with said second longitudinal marginal portion of said trampoline;

(e) second fabric means for defining a second plurality of loops spaced apart from one another along said second longitudinally-extending marginal portion of said trampoline;

(f) a pair of rods, one extending through said first plurality of loops and the other extending through said second plurality of loops; and (g) flexible lacing means extending around said rods between said fabric loops with said second longitudinally-extending marginal portion of said trampoline extending around one of said longitudinal frame members toward said first fabric means for applying lateral tension to said trampoline.

10. The catamaran of claim 9, including elastically extensible means connected with said lower rear portions of said flexible bottom section, extending rearwardly beneath said trampoline and fastened to a portion of said catamaran spaced rearwardly apart from said upper section of said utility container, for urging said flexible bottom portion rearwardly and upwardly toward said trampoline.

11. The catamaran of claim 9, including means defining a plurality of separate compartments within said utility container.

12. The catamaran of claim 9, including respective port and starboard ends of said utility container and having strap means connected with said port and starboard ends for attaching said utility container to said catamaran.

13. The catamaran of claim 9, including transverse structural members interconnecting said pair of hulls, said upper section of said utility container including front and rear transversely-extending marginal portions, means associated with said front marginal portion for connecting said utility container to a forward one of said transversely extending structural members, and means associated with said rear marginal portion for connecting said rear marginal portion to said trampoline, and said trampoline including a transversely-extending rear marginal portion and means for attaching said rear marginal portion to said rear one of said transversely-extending structural members, said means for connecting said front marginal portion to said forwardly located one of said transversely extending structural members including means for applying tension to said trampoline in a fore-and-aft direction.

* * * * *